US007887017B2

(12) United States Patent
Moran

(10) Patent No.: US 7,887,017 B2
(45) Date of Patent: Feb. 15, 2011

(54) HANGER, DECORATIVE ITEM INCORPORATING THE SAME, AND METHOD THEREFOR

(76) Inventor: Korina Moran, 29 Sherwood Ave., Ossining, NY (US) 10562

( * ) Notice: Subject to any disclaimer, the term of this patent is extended or adjusted under 35 U.S.C. 154(b) by 328 days.

(21) Appl. No.: 12/062,752

(22) Filed: Apr. 4, 2008

(65) Prior Publication Data

US 2008/0245751 A1 Oct. 9, 2008

Related U.S. Application Data

(60) Provisional application No. 60/910,440, filed on Apr. 5, 2007.

(51) Int. Cl.
*B42F 13/00* (2006.01)

(52) U.S. Cl. ..... 248/339; 248/340; 248/301; 248/304; 248/307; 248/215; 248/328

(58) Field of Classification Search ..... 248/339, 248/340, 301, 304, 307, 215, 328; 211/119.004, 211/113; D8/367, 373
See application file for complete search history.

(56) References Cited

U.S. PATENT DOCUMENTS 1,805,984 A * 5/1931 Hull ..... 248/304
2,534,067 A * 12/1950 Rubin ..... 473/487
2,696,962 A * 12/1954 Goss ..... 248/477
3,536,287 A * 10/1970 Hyman ..... 248/301
4,019,707 A * 4/1977 Quinn et al. ..... 248/95
4,955,605 A * 9/1990 Goldfarb ..... 273/375
D315,669 S * 3/1991 Paul ..... D8/370
5,064,195 A * 11/1991 McMahan et al. ..... 473/480
5,123,223 A * 6/1992 Makarevich et al. ..... 52/311.1
5,375,799 A * 12/1994 Rhodes ..... 248/95
D360,355 S * 7/1995 Adams ..... D8/367
5,553,823 A * 9/1996 Protz, Jr. ..... 248/304
5,803,422 A * 9/1998 Buehler ..... 248/339
6,302,365 B1 * 10/2001 Catanzarite et al. ..... 248/339
D465,724 S * 11/2002 Goodman et al. ..... D8/367
6,592,952 B1 7/2003 Ferguson
D494,050 S * 8/2004 Klein et al. ..... D8/373
6,863,249 B1 * 3/2005 Alvord ..... 248/95
6,921,561 B1 * 7/2005 Maier ..... 428/11
7,185,864 B2 3/2007 Adams
7,207,088 B2 * 4/2007 Adams et al. ..... 16/413
7,234,671 B2 * 6/2007 Avinger ..... 248/215

OTHER PUBLICATIONS

Amazon. Wreath hangers. Downloaded at http://www.amazon.com on Oct. 18, 2006.

* cited by examiner

*Primary Examiner*—Terrell Mckinnon
*Assistant Examiner*—Michael McDuffie
(74) *Attorney, Agent, or Firm*—Holland & Hart LLP

(57) ABSTRACT

Provided is a decorative item adapted to be suspended from a dwelling closure, including a hanger bracket that has an upper hook portion for placement over a top of the dwelling closure, a lower support portion, and an elongate suspension arm extending therebetween. A decoration is supported by the lower support portion and a self-contained power supply is mounted to the upper hook portion for providing power to the decoration.

10 Claims, 3 Drawing Sheets

HANGER, DECORATIVE ITEM INCORPORATING THE SAME, AND METHOD THEREFOR

BACKGROUND

The doorway of a building is often the focal point of the structure as it marks the transition point from one environment to another. The appearance of the doorway and the door itself can convey a mood and communicate an expectation of what lies beyond. For example, the imposing Romanesque columns of a courthouse communicate a solemn atmosphere indicative of the proceedings held within. On the other hand, the natural wood colors and finishes of a log cabin convey a mood of warmth and tranquility. Given the significance of the front entryway of a building or home people often decorate the front door in order to convey a particular mood or atmosphere. This is especially true for holidays and significant events.

In the United States, for example, the holidays that are key for decorating are Valentine's Day, Easter, Fourth of July, Halloween, Thanksgiving, Christmas, and Hanukkah. Additionally, as the trend for decorating geared to a particular theme expands, other events such as New Year's Eve, St. Patrick's Day, Memorial Day and Labor Day have become decorating events. Other occasions such as March Madness (basketball), Super Bowl Day (football) and the like give rise to decorative themes. Seasonal themes may include the advent of spring, fall harvest, and the like.

People decorate their doors in different ways. Sometimes, a large gift-wrap style adornment is wrapped over the entire surface of the door to cover and decorate the whole surface. In other cases people prefer to use a smaller decoration such as a wreath, swag, garland, seasonal character face, icon, or symbol of the holiday.

Various ways of hanging these decorations on a door are known. Many people with a wooden door will simply hammer a nail or use a screw to hang a decoration. A metal door allows the use of a magnetic hanger. A suction-cup hook is often used to hang decorations from glass doors. A very popular means of hanging ornaments to a door is a large hook that hangs over the top of the door.

While these current methods of hanging decorations on a door are effective, they do have various drawbacks. First of all decorating a door with these methods can sometimes damage or disfigure the door. This can happen for several reasons. The nail, screw, or hole they leave behind will be visible without the decoration in place. Magnetic hooks can be so strong that they are difficult to remove without scratching the paint on the door. Traditional hangers, which are generally made of either hard plastic or metal, can leave marks by scratching the doors surface at various points.

Another issue that can arise from displaying a decoration on a door with current methods is the loss of or damage to the decoration. For example, even moderate winds can blow a decoration off of a door. Many times, in inclement weather, a simple nail or screw does not have enough strength or length to hold the decoration in place. Constant use of the door may cause the nail or screw to become loose or dislodged over time. Also, a hook or hanger sometimes gets jostled or tilted from opening and closing the door. Finally, these simple methods for hanging decorations provide very little protection against theft and or vandalism of the decoration.

Another aspect of holiday decorations is the desirability of adding lights to enhance the decoration. It is possible to run an electrical cord over or under a door to light a decoration, especially on a door that is not often used. However, in addition to being cumbersome and unsightly, using an electrical cord in this manner has the potential to be dangerous. Operation of the door could potentially damage the electrical cord, thereby exposing electricity to human contact. In other instances, a small battery pack is incorporated into the decoration, which is mounted to the front of the door. However, this exposes the battery pack to the elements as well as to theft. This arrangement also requires a battery pack for each decoration.

Accordingly, there is a need for improved decoration hangers and decorative items incorporating improved hangers that can be used on a door or other suitable structure that prevents damage to the structure, and is effective in supporting the decoration with a reduced risk of loss or damage. Furthermore, there is a need for an improved decoration hanger that provides a safe and convenient means of powering electrical components used in the decoration.

SUMMARY

Provided is a decorative item adapted to be suspended from a dwelling closure, such as, for example, a door or window. The decorative item includes a hanger bracket including an upper hook portion for placement over a top of the dwelling closure, a lower support portion, and an elongate suspension arm extending therebetween. The lower support portion supports a decoration and the upper hook portion has a plurality of holes formed therethrough for mounting a self-contained power supply that provides power to the decoration. The decoration includes a wired framework and may be slideably attached to the lower support portion.

The decorative item may include padding disposed on the hanger bracket to provide a protective interface between the hanger bracket and the dwelling closure. The lower portion of the hanger bracket may be configured as a hook to displace the decoration from a front of the dwelling closure.

The hanger bracket may be integrally formed from a single piece of material such as elongate sheet metal and include a channel formed in the hanger bracket between the upper hook portion and the lower support portion. Preferably, the self contained power supply is a battery pack, and includes wiring interconnecting the battery pack to the decoration. Advantageously, the wiring may be disposed within the channel.

Also contemplated is a decorative item kit that includes a hanger adapted to be suspended from a dwelling closure, a plurality of interchangeable decorations each adapted to be supported by the hanger, and a self-contained power supply supported by the hanger for providing power to the interchangeable decorations. Preferably, the self-contained power supply is a battery pack mounted to an upper hook portion of the hanger such that the battery pack is concealed from view from a region in front of the dwelling closure.

A method of decorating a dwelling closure is also provided. The method includes providing a hanger bracket along with a self-contained power supply mounted to the hanger bracket that is in electrical communication with a decoration. The hanger bracket's upper hook portion is placed over a top of the dwelling closure such that the lower support portion of the hanger is suspended therebelow, so that the self-contained power supply is concealed from view from a region in front of the dwelling closure. The self-contained power supply is turned on to provide power to the decoration. The method may further comprise interchanging the decoration with another decoration. The decoration may be mounted to the hanger prior to placing the hanger bracket's upper hook portion over a top of the dwelling closure or the hanger may be placed and then the decoration mounted.

DETAILED DESCRIPTION

The exemplary embodiments of the present invention are designed to be suspended over dwelling closures or other suitable structures such as, for example, a mantle. Dwelling closures include doors, windows and other similar dwelling structures. The exemplary embodiments are suspended over these structures in a similar fashion as a traditional wreath decoration hanger but it includes protective pads to prevent the damage to the structure that can sometimes be caused by the traditional hanger. Also, the decoration on the front of the hanger is secured to the hanger to prevent loss or damage. A self-contained power supply such as a battery pack is mounted to the hook portion of the hanger to provide a safe convenient power source that is protected from the elements.

Figure 1:
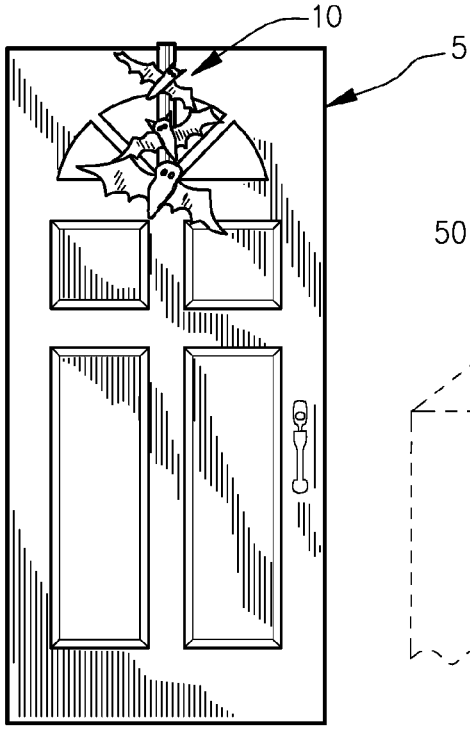
FIG. 1 illustrates an entryway door that is adorned with a decorative item according to a first exemplary embodiment of the present invention.
Figure 2:
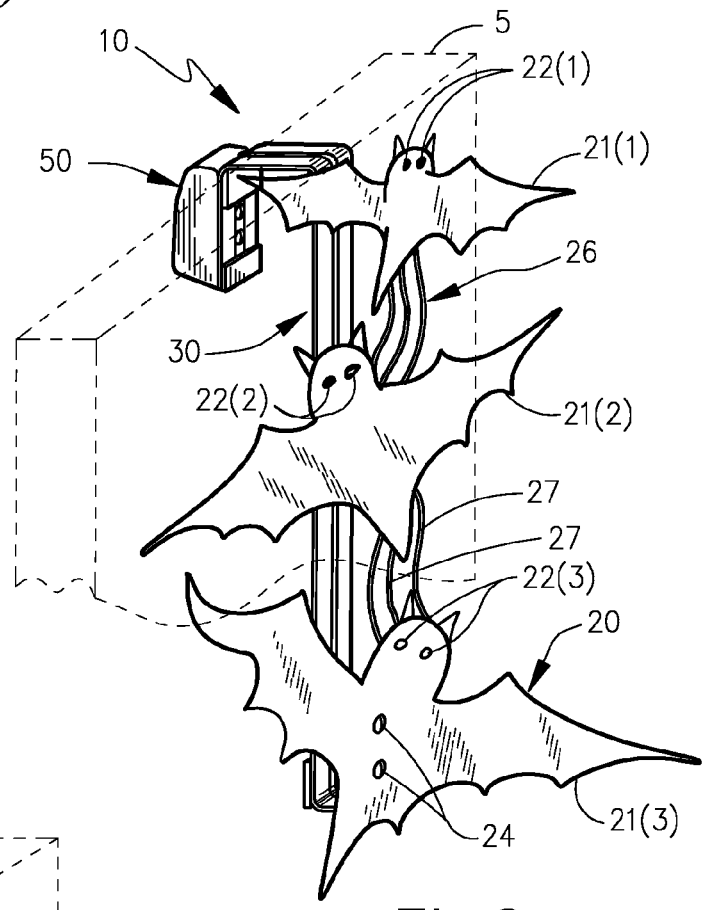
FIG. 2 is a perspective view that illustrates in more detail the decorative item shown in FIG. 1 with a portion of the door shown in phantom.

FIG. 1 illustrates a typical entryway door 5 adorned with a decorative item 10 according to a first exemplary embodiment of the present invention. In this case decorative item 10 has a Halloween theme, which includes a plurality of bats. With reference to FIG. 2 it can be seen that decorative item 10 includes decoration 20, which is attached to hanger 30. In this case, an optional battery pack 50 is attached to hanger 30 for powering lights 22(1)-22(3) on decoration 20. For instance, the bats' eyes 22(1)-22(3) are LED lights, which are powered by battery pack 50 via an insulated wire pair 40, which is described more thoroughly below. In this embodiment, the decoration 20 is mounted to hanger 30 with fasteners 24. Fasteners 24 could be screws, bolts, rivets, or the like. It should be understood that decoration 20 can be mounted by other suitable means such as with a suitable adhesive or double-sided tape. Decoration 20 can also be slideably attached for easy interchangeability of decorations. For instance, the decoration may include a dovetail groove that slides onto the hanger. Decoration 20 includes three bats 21(1)-21(3) that are supported by frame 26. In this case, frame 26 includes a plurality of heavy wires 27. As can be seen in FIG. 2 frame 26 is connected to bracket 30 at one end, which allows some motion of the bats and creates a kinetic decoration. Alternatively, the decoration 20 could be attached to the hanger bracket 30 at its center of mass for a more stable design, which reduces movement of the decoration 20.

Figure 3:
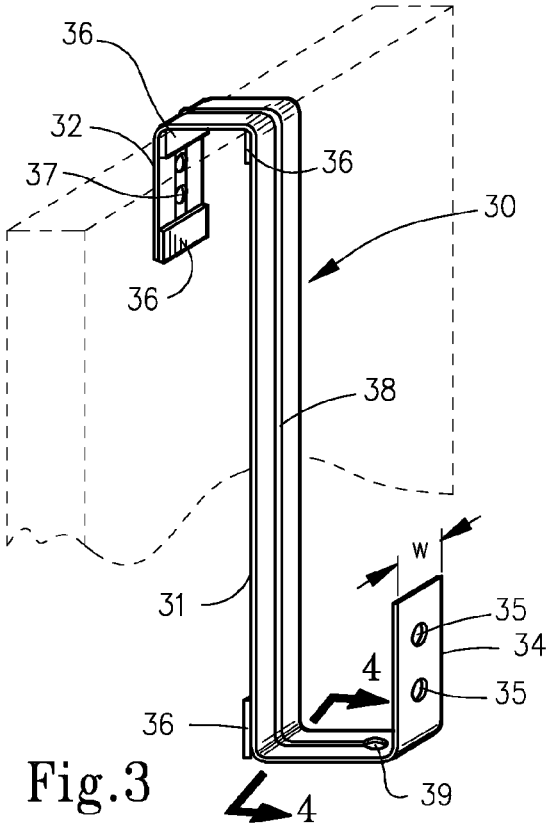
FIG. 3 is a perspective view illustrating the structure of the hanger.

FIG. 3 illustrates the hanger 30 shown in FIG. 2 with decoration 20 and battery pack 50 removed for ease of explanation. Hanger bracket 30 includes a decoration support portion 34 and a hook portion 32 with an elongate suspension arm 31 extending therebetween. Hook portion 32 supports the entire hanger bracket 30 from the top of door 5. In this case, hook portion 32 is sized and configured for placement over the top of door 5. In order to protect the door 5 from damage, hanger bracket 30 includes pads 36, which are placed as shown in FIG. 3, adjacent to the bracket for confronting the door surfaces. The pads 36 are protective cushions that protect the finish on the door as well as the structure of the door. The pads 36 can be made of felt, rubber, plastic, or the like and can be mounted in any suitable fashion such as with adhesive. Hook portion 32 also includes holes 37 for receivably mounting a battery pack 50. Where a battery pack is not needed, holes 37 can be used to mount an additional decoration such as jack-o-lantern 1390 shown in FIG. 13. Decoration support portion 34 includes holes 35 for attaching decoration 20. The battery pack 50 and decoration 20 may be attached, as is known in the art, with screws, rivets, glue, or the like. Hanger bracket 30 is preferably integrally formed from the same material. For instance, hanger bracket 30 may be formed of sheet metal by bending an elongate piece of sheet metal of width W in order to form the hook 32 and the decoration support 34. Alternatively the hanger bracket 30 may also be formed of any suitable plastic material.

Figure 4:
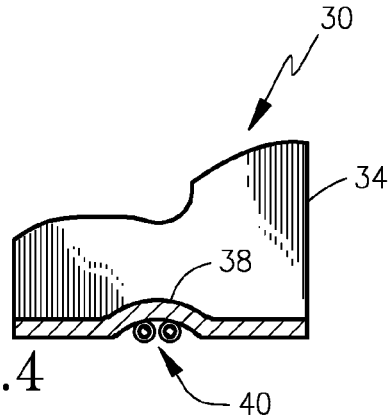
FIG. 4 is a partial view shown in cross-section taken about lines 4-4 of FIG. 3.

Hanger 30 also includes a raised channel 38 for receiving wires 40 to connect battery pack 50 to lights on decoration 20, such as the bats eyes 22(1)-22(3) shown in FIG. 2. FIG. 4 shows a partial cross-section of hanger bracket 30 illustrating the raised channel 38 with wires 40 disposed therein. Wires 40 may be taped, glued, or otherwise suitably retained in channel 38. It should be noted that channel 38 runs the length of the hanger 30 from where battery pack 50 attaches to hole 39, which allows access for the wires to be connected to the decoration. From a structural standpoint raised channel 38 also provides additional strength to the bracket.

Figure 5:
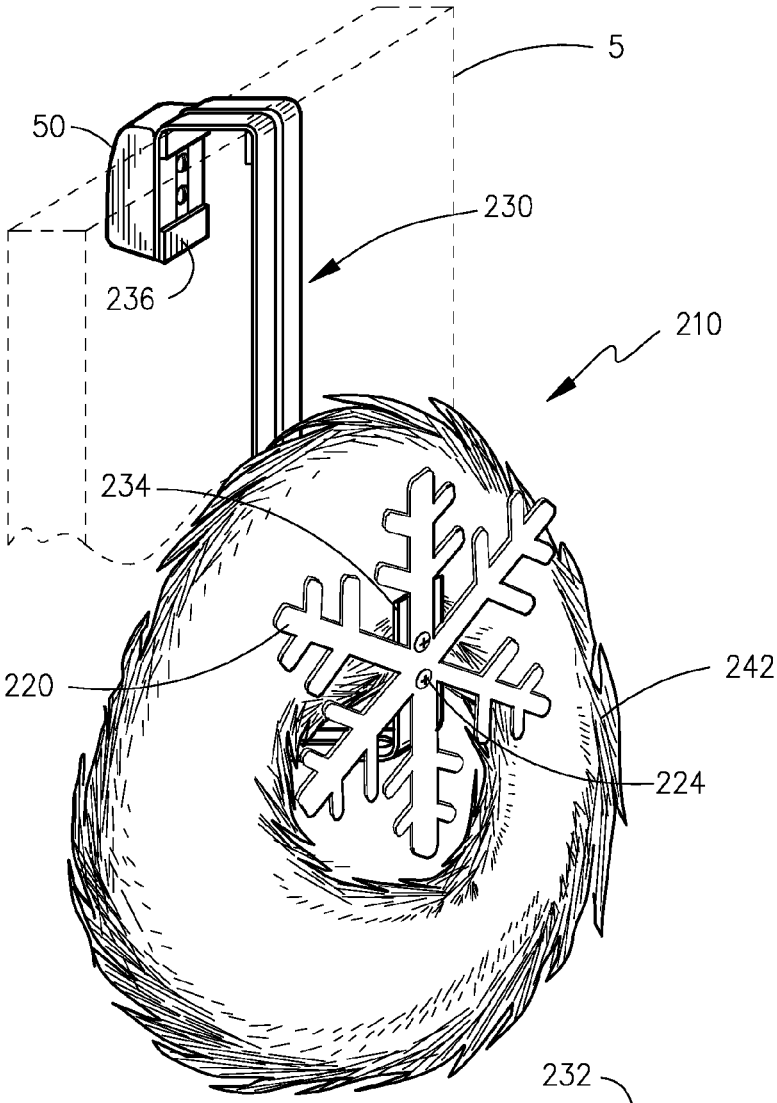
FIG. 5 is a perspective view illustrating a second exemplary embodiment of the decorative item.

FIG. 5 illustrates a second exemplary embodiment of the decorative item. Decorative item 210 is similar to the first embodiment; however, in addition to decoration 220, the hanger 230 is formed such that it supports another decoration such as a stocking or as shown here a wreath 242. In this case decoration 220 is in the form of a large snowflake representing a winter theme. Snowflake 220 is attached to the decoration support portion 234 by fasteners 224. In this embodiment the decorative item 210 also includes battery box 50, which can be connected to the decoration 220 for lighting purposes. Hanger bracket 230 is similar to the first embodiment's door hanger; however, the decoration support portion is spaced further away from the door to allow room for wreath 242 to rest.

Figure 6:
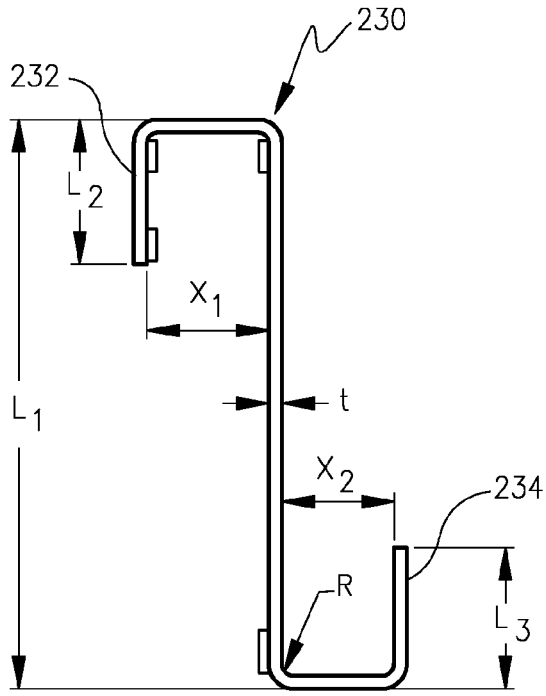
FIG. 6 is a side view in elevation of the hanger.

FIG. 6 is a side view of hanger 230 showing its dimensions. Hook portion 232 can be sized to fit various doors by changing dimensions $X_1$ and $L_2$. However, $X_1$ is preferably approximately 2 inches and $L_2$ approximately 4.25 inches. The overall length $L_1$ of the hanger bracket 230 is preferably 16 inches. However, the overall length $L_1$ may be varied depending on the size and nature of the decoration attached to decoration support portion 234. In this embodiment, the decoration support portion 234 is spaced a distance $X_2$ from the bracket at a distance of at least 3.5 inches, which is ideal for supporting a wreath 242 as shown in FIG. 5. However, in the case where the hanger bracket is intended to only support a decoration, such as in FIG. 2, spacing $X_2$ is preferably approximately 1.0 inch. A 1.0 inch spacing here allows clearance for molding on the door and prevents the decoration from damaging the surface of the door. Finally, decoration support 234 has a length $L_3$, which in this case is preferably 4¼". Width W, as shown in FIG. 3, is preferably approximately 1.5 inches. In this case, the hanger bracket 230 is formed of sheet metal thickness t, which could be any standard sheet metal thickness such as 1/16 inch.

Figure 7:
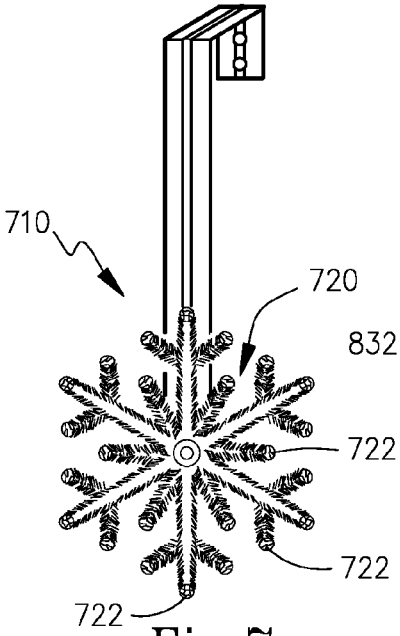
FIG. 7 is a perspective view illustrating an alternative decoration construction attached to the hanger.
Figure 8:
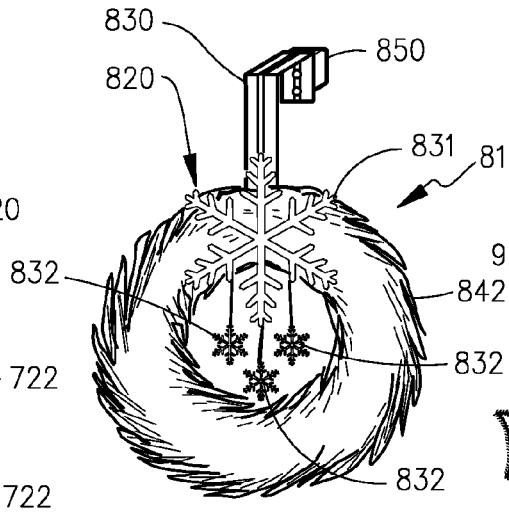
FIG. 8 is a perspective view illustrating an alternative decoration construction according to the second exemplary embodiment, which includes a wreath.
Figure 9:
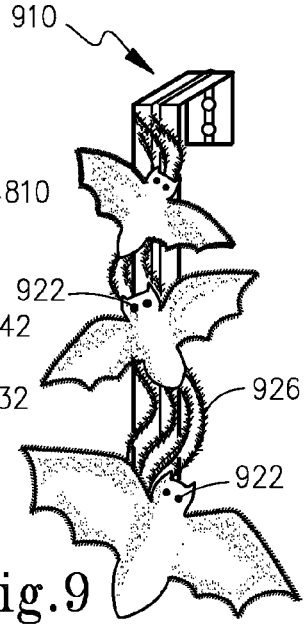
FIG. 9 is a perspective view showing in detail the decoration construction as shown in FIGS. 1 and 2.
Figure 10:
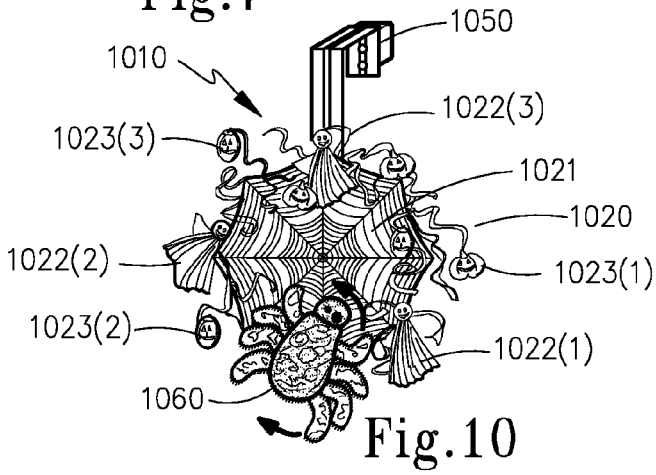
FIG. 10 is a perspective view illustrating an alternative decoration construction attached to the hanger according to the first exemplary embodiment, shown here as a spider web surrounded by ghosts, pumpkins, and spiders.
Figure 11:
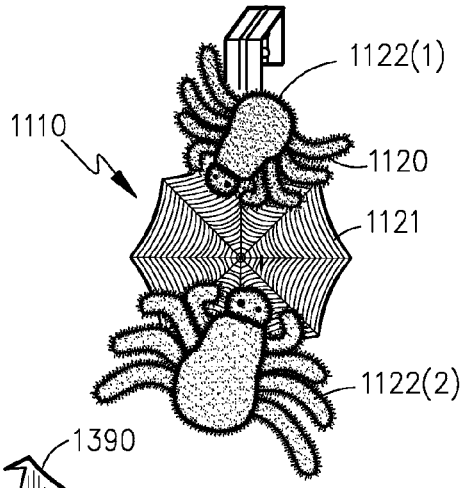
FIG. 11 is a perspective view illustrating another alternative decoration construction attached to the hanger according to the first exemplary embodiment, shown here in the form of two large spiders and a spider web.
Figure 12:
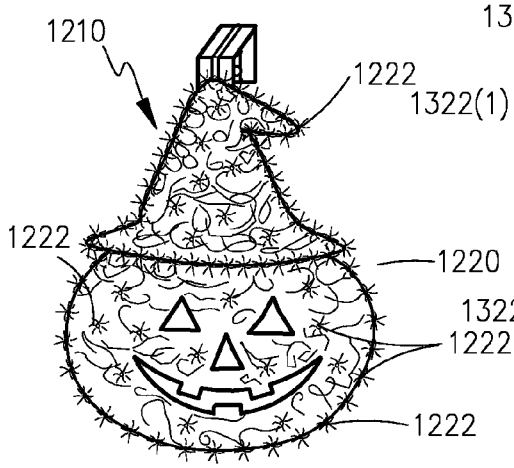
FIG. 12 is a perspective view illustrating another alternative decoration construction, in the form of a jack-o-lantern, attached to the hanger according to the first exemplary embodiment.
Figure 13:
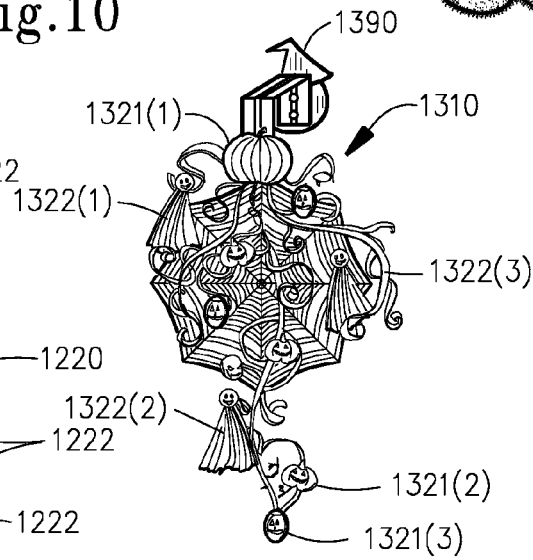
FIG. 13 is a perspective view illustrating yet another alternative decoration construction, with pumpkins and ghosts, attached to the hanger according to the first exemplary embodiment.

While the exemplary embodiments described above include specific design examples it should be understood that a large variety of decoration designs could be used. For instance, FIGS. 7-13 illustrate various alternative constructions for decorations. For example, FIG. 7 illustrates a decorative item 710 constructed of pine boughs arranged in the form of a snowflake with LED lights 722 at the ends of the boughs. FIG. 8 illustrates a decorative item 810 according to the second exemplary embodiment. A wreath 842 is supported by hanger bracket 830. Decoration 820 is also attached to the hanger bracket 830. Decoration 830 includes a large snowflake 831 and three smaller snowflakes 832 suspended therefrom. In this case large snowflake 831 is lighted with fiber-optic filaments. Also, snowflakes 832 are lighted with LED lights. FIG. 9 illustrates a decorative item 910 similar in design to that shown in FIG. 2, however the frame 926 is wrapped with fiber-optic in addition to lights 922 for the bats' eyes. FIG. 10 illustrates a decorative item 1010 according to the first embodiment but including an alternative decoration 1020, which includes a spider web 1021 surrounded by ghosts 1022(1)-1022(3), jack-o'-lanterns 1023(1)-1023(3), and a large spider 1060. It should be understood that battery pack 1050 can be used not only to power LED lights but also small motors and mechanisms. For example, spider 1060 could be mounted to a small motor for rotation or reciprocation. FIG. 11 illustrates another alternative decoration 1120, which includes a spider web 1121 and two large spiders 1122(1) and 1122(2). FIG. 12 illustrates a jack-o'-lantern design 1220 covered in lights 1222. Finally, FIG. 13 illustrates a vine design including pumpkins 1321(1)-1321(3) and ghosts 1322(1)-1322(3). It should also be understood that while the exemplary embodiments are discussed with respect to placement on a door, other dwelling closures and structures may be suitable for supporting the decorative item.

A method is also contemplated for hanging a decorative item. This method may include any steps inherent in any of the disclosed embodiments. Broadly, the method includes suspending a decoration from a structure with a hanger. The method also includes providing a power supply for powering electrical components on the decoration where the power supply is located at the anchored end of the hanger. Where the decoration is displayed on an exterior structure such as on a door, it is preferable that the power supply be located in the interior of the structure thereby protecting it from outdoor elements.

Accordingly, the present invention has been described with some degree of particularity directed to the exemplary embodiment of the present invention. It should be recognized, however, that the present invention is defined by the following claims construed in light of the prior art so that modifications or changes may be made to the exemplary embodiment of the present invention without departing from the inventive concepts contained herein.

What is claimed is:

1. A decorative item adapted to be suspended from a dwelling closure, comprising:

a. a hanger bracket including an upper hook portion for placement over a top of the dwelling closure, a lower support portion configured as a hook, and an elongate suspension arm extending therebetween and having a channel formed therein;

b. a decoration supported by said lower support portion;

c. a self-contained power supply in the form of a battery, said self-contained power supply mounted to said upper hook portion for providing power to said decoration; and d. wiring disposed within said channel for interconnecting said battery pack to said decoration.

2. A decorative item according to claim l including padding disposed on said hanger bracket.

3. A decorative item according to claim 2 wherein said padding includes a plurality of pads to provide a protective interface between said hanger bracket and the dwelling closure.

4. A decorative item according to claim l wherein said upper hook portion includes a plurality of holes formed therethrough for mounting said power supply.

5. A decorative item according to claim 1 wherein said hanger bracket is integrally formed from a single piece of material.

6. A decorative item according to claim 5 wherein said material is elongate sheet metal.

7. A decorative item according to claim 5 wherein said material is plastic.

8. A decorative item according to claim 1 wherein said decoration includes a wired framework.

9. A decorative item according to claim 1 wherein said decoration is slideably attached to said lower support portion.

10. A decorative item according to claim 1 including a plurality of interchangeable decorations each adapted to be supported by said hanger.

* * * * *